US005263764A

United States Patent [19]

Laughlin et al.

[11] Patent Number: 5,263,764

[45] Date of Patent: Nov. 23, 1993

[54] MULTI-FUNCTIONAL UPHOLSTERED FURNITURE SYSTEM

[75] Inventors: Glenn M. Laughlin, High Point, N.C.; Jeffrey A. Frank, Arlington, Va.; Bruce Hirschhaut, High Point, N.C.

[73] Assignee: JBG Original Designs Incorporated, High Point, N.C.

[21] Appl. No.: 720,369

[22] Filed: Jun. 25, 1991

[51] Int. Cl.[5] ..... A47C 7/00

[52] U.S. Cl. ..... 297/440.23; 297/218

[58] Field of Search ..... 297/440, 218, 219, DIG. 6, 297/443, 444

[56] References Cited

U.S. PATENT DOCUMENTS

| | | | |
|---|---|---|---|
| 3,129,472 | 4/1964 | Hensel . | |
| 3,658,382 | 4/1972 | Anderson | 297/443 X |
| 3,695,690 | 10/1972 | Carson | 297/218 |
| 3,774,966 | 11/1973 | Faulkner et al. | 297/218 X |
| 3,799,611 | 3/1974 | Steinfeld . | |
| 3,842,456 | 10/1974 | Bronstein, Jr. | 297/218 X |
| 3,951,558 | 4/1976 | Komarov . | |
| 3,966,340 | 6/1976 | Morris . | |
| 4,012,155 | 3/1977 | Morris . | |
| 4,025,216 | 5/1977 | Hives . | |
| 4,165,902 | 8/1979 | Ehrlich | 297/440 |
| 4,204,287 | 5/1980 | Lane et al. . | |
| 4,261,667 | 4/1981 | Ervin et al. . | |
| 4,292,003 | 9/1981 | Pond . | |
| 4,305,616 | 12/1981 | Martinez | 297/440 |
| 4,365,840 | 12/1982 | Kehl et al. | 297/444 X |
| 4,668,011 | 5/1987 | Fister, Jr. | 297/218 |
| 4,711,495 | 12/1987 | Magder . | |
| 4,883,331 | 11/1989 | Mengel . | |
| 4,886,326 | 12/1989 | Kuzyk . | |
| 4,893,958 | 1/1990 | Wieland . | |
| 4,932,720 | 6/1990 | Sherman | 297/440 |
| 4,944,627 | 7/1990 | Durney . | |
| 5,007,681 | 4/1991 | Meier et al. | 297/440 |
| 5,069,506 | 12/1991 | Wieland . | |
| 5,135,284 | 8/1992 | Crum . | |

OTHER PUBLICATIONS

Flotura Sleeper Fixture With Universal Mounting Plate, 1979.

Mounting Dimensions Model 900 Sleeper, 1979.

Promotional All-Link Flotura 43275 Series, 1979 1979.

Low Cavity Flotrua 43795 Series, 1979.

*Primary Examiner*—Jose V. Chen

*Attorney, Agent, or Firm*—Spencer, Frank & Schneider

[57] ABSTRACT

An upholstered furniture system having removable and interchangeable spring and sleeper units for mounting on a substantially horizontal surface. The system comprises first and second spaced apart substantially vertical arm members, a back member which is removably attached to the arm members and a front member which is in removable contact with the arm members. A seat support member, which may be one of a spring platform and a sleeper mechanism, is removably supported by first and second side support sections affixed to the inner surfaces of the first and second arm members. A cover may be secured to the arm, back and front members by hook and loop fastening strips.

19 Claims, 7 Drawing Sheets

MULTI-FUNCTIONAL UPHOLSTERED FURNITURE SYSTEM

BACKGROUND OF THE INVENTION

This invention relates to furniture, and in particular to furniture having interchangeable components.

In conventional upholstered furniture, such as chairs, loveseats, sofas and sleepers, the standard method of construction utilizes a fully assembled wood or wood-product frame having a seat, a front rail and a back rail. The frame is covered by a non-removable fabric covering, and upholstery consisting of materials such as fiber and foam are attached to the fabric covering. Springs, webbing or other means of support are permanently attached below the seat to the front and back rails. The pitch of the seat is determined by the difference in height between the front and back rails.

It is also conventional to provide furniture having a sleeper mechanism and folding mattress permanently attached to a wood frame. However, conventional furniture designed to receive a sleeper mechanism requires a completely different size and design of frame than a non-sleeper sofa having the same appearance. The spring units used in conventional sofas and the sleeper mechanisms used in sleeper-type sofas are not interchangeable either before or after the upholstering process.

Back cushions used with both types of furniture, sleeper and non-sleeper, may be either "tight" (upholstered as part of the overall frame) or "loose" (individual cushions separate from the frame). In both types of furniture, once the frame has been completed only minimal modifications can be made in the shape and style of the upholstered piece. It cannot be altered once the fabric covering has been attached.

The design of conventional upholstered furniture imposes many limitations on the manufacturer, the retailer and the consumer. The manufacturer is faced with an industry that demands constant style changes, although such changes are difficult to make because there are few interchangeable parts among the many different styles and few styles are popular for more than two or three years. As a result, he is forced to periodically design and fabricate new components for each style. Frequent redesign of the product and retooling of production equipment imposes a heavy burden on the manufacturer in terms of both inventory control and maintaining manufacturing efficiency.

Another limitation on the manufacturer is that upholstered furniture tends to be large, bulky and heavy. Accordingly, shipping is expensive with the result that it is rarely cost-effective for a manufacturer of upholstered furniture to ship his products over long distances. Consequently, many manufacturers of upholstered furniture find that they must have several factories located in different parts of the country to reduce freight costs. The high cost of freight also accounts for the fact that few upholstered products produced in this country are exported overseas. In addition, cartons suitable for the shipping of furniture are quite expensive, and this has lead manufacturers to ship upholstered items in less protective plastic wraps thereby risking damage to their products.

The retailer of upholstered furniture also faces many problems. Since the product is bulky, expensive display and warehousing facilities must be provided. The typical customer is seeking a wide selection of styles, designs and sizes to choose from, and often demands immediate delivery once he has made his choice. It is difficult for a retailer to provide such service without huge inventory, warehouse and showroom costs.

Another problem faced by the retailer is that merchandise not sold in a relatively short time tends to become soiled or broken. Cleaning upholstered furniture is difficult and repairs usually require the services of a skilled technician. Both are expensive. Fast selling products can also create problems because reorders usually take six to twelve weeks, and this means the retailer may be without a best seller for an extended period of time.

Shopping for upholstered furniture can be a frustrating experience for the consumer. The typical retail purchaser is often unfamiliar with the brand names of upholstered furniture and there is no practical way he or she can check the quality of an item. Locating a suitable item may be difficult because some stores sell only sofas and chairs with few loveseats, while others sell only sleepers. Even enormous warehouse showrooms cater only to the most popular tastes of the moment. Less popular sizes and styles are not stocked by most retailers.

The consumer must make a wide range of decisions before and after purchasing furniture. In the case of a sofa, consideration must be given to matching the sofa with existing room decor, and predictions must be made as to whether the sofa whose purchase is contemplated will harmonize with possible future decorating schemes. After the sofa has become worn, it may be covered with custom slip covers. However, such covers are usually expensive, clumsy and fit loosely thereby obscuring the tailored look of the original sofa design. Reupholstry costs are nearly the same as buying a new piece and, as explained above, even simple cleaning of an upholstered piece is difficult and best left to professionals. In addition, while the frame of a sofa or chair normally lasts far longer than the fabric or cushions, the current state of upholstered furniture technology does not permit cost-effective recycling of the furniture frame.

Still another limitation placed upon the consumer is that he or she must decide whether or not to buy a sofa of a type suitable for sleeping. Current upholstered furniture technology does not allow the installation of a sleeper mechanism and mattress in a sofa of the non-sleeper type.

There have been attempts to correct some of these design limitations. For example, the Faulkner et al. U.S. Pat. No. 3,774,966 discloses a knock-down sofa having replaceable parts. However, the sofa disclosed in this patent provides little flexibility in styling, employs a simple frame construction which is not easily adaptable to a large number of styles and designs, and cannot accommodate a sleeper mechanism.

There have also been attempts to improve the design of conventional upholstered furniture by making improvements in removable slip covers. Such covers have several advantages in that they can be removed for cleaning, replaced if damaged and changed when redecorating. For example, U.S. Pat. No. 3,248,147 to Testa discloses a removable slip cover that simulates a tailored appearance similar to conventional upholstered furniture. However, the upholstery assembly disclosed by Testa is relatively expensive because it uses both sub-upholstery and a removable cover over the sub-upholstery. The Testa chair cannot accommodate a sleeper mechanism and provides little flexibility in styling. The frame construction described in Testa is suitable only for chairs or sofas with substantially perpendicular arms. A curved arm recovered using Testa's method would appear to be straight.

SUMMARY OF THE INVENTION

The present invention provides an item of upholstered furniture which can accommodate either a removable spring platform or a sleeper mechanism and mattress, utilizes a knock-down frame with interchangeable parts and permits the fabric cover to be replaced easily and quickly. Thus, it is an object of our invention to provide an item of upholstered furniture having removable and interchangeable spring and sleeper units.

Another object of the invention to provide an item of upholstered furniture, having interchangeable parts which can be easily assembled and disassembled.

A further object is to provide an upholstered furniture frame which allows the use of multiple styles and designs of removable covers.

Specifically, our invention comprises an item of upholstered furniture having removable and interchangeable spring and sleeper units comprising first and second spaced apart substantially vertical arm members combined with removable back and front members interposed between the arm members. First and second side support sections are affixed to inner surfaces of the first and second arm members, and each of the side support sections has a side support member with a top surface extending at an acute angle with respect to a horizontal surface on which the chair is placed from the front portion of the side member to a step portion intermediate its front and back ends. The first and second side support sections are further provided with means for attaching a seat support member which may be either a spring platform or a sleeper mechanism. The spring platform is removably supported by the top surfaces of the side support members and backward movement of the spring platform restricted by the step portions of the side support members. The the sleeper mechanism is supported by the attachment means.

The invention also includes an upholstered item of knock-down furniture wherein the back member comprises first and second back insert sections having upper and lower portions removably attached to the first and second spaced apart vertical arm members, and back, top and intermediate horizontal rails attached between the back insert sections. Upholstery is secured to the arm, back and front members.

Another feature of the invention is the provision of means for removably attaching a fabric cover to the arm, front and back members by means of hook and loop fastening strips.

DESCRIPTION OF THE PREFERRED EMBODIMENTS

Figure 1:
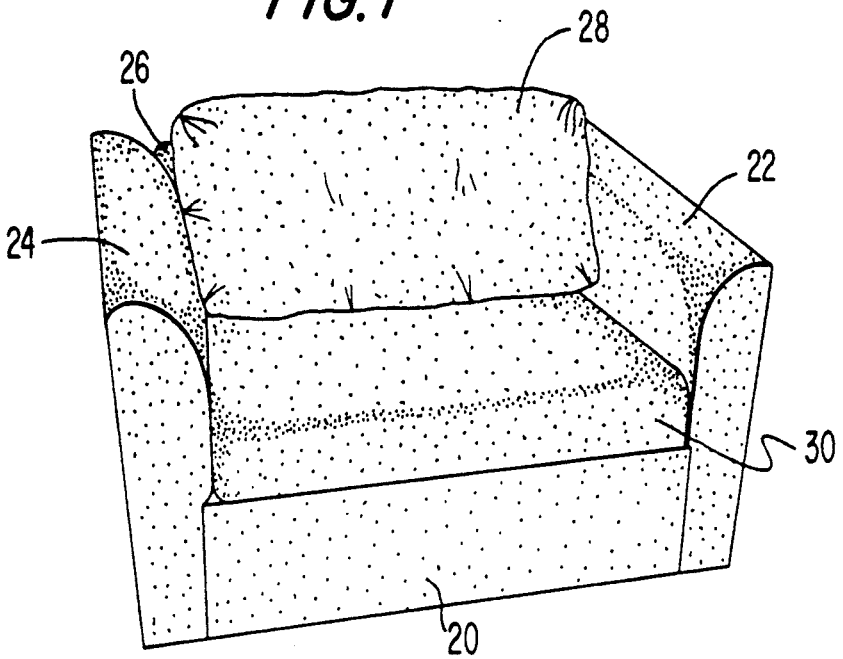
FIG. 1 is a perspective front view of a chair embodying the invention.
Figure 9:
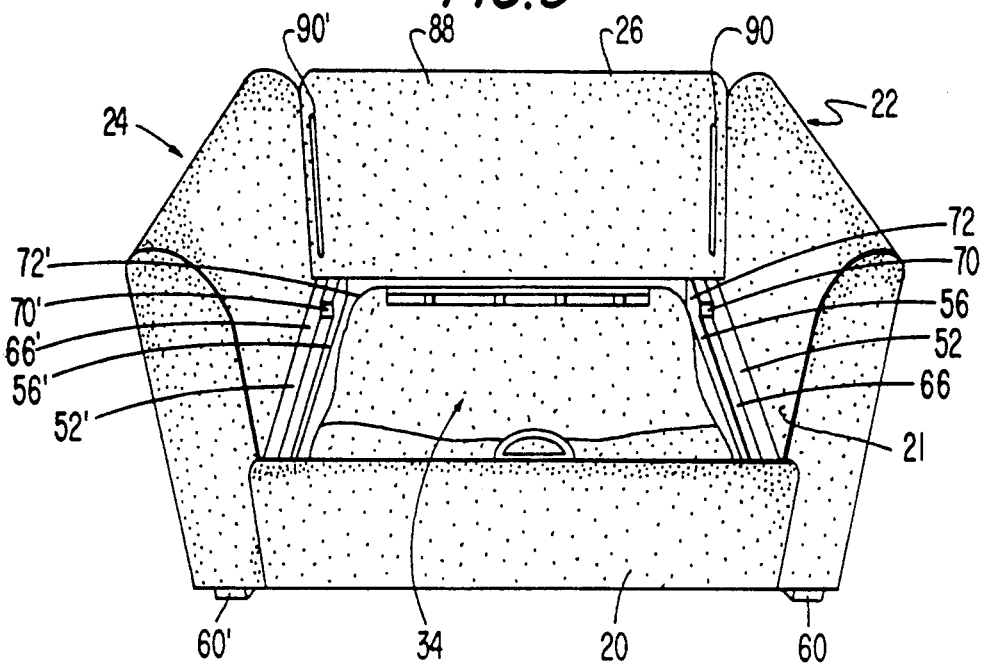
FIG. 9 is a front view of the chair with the seat cushion and back cushion removed, and with the sleeper mechanism and mattress installed.
Figure 10:
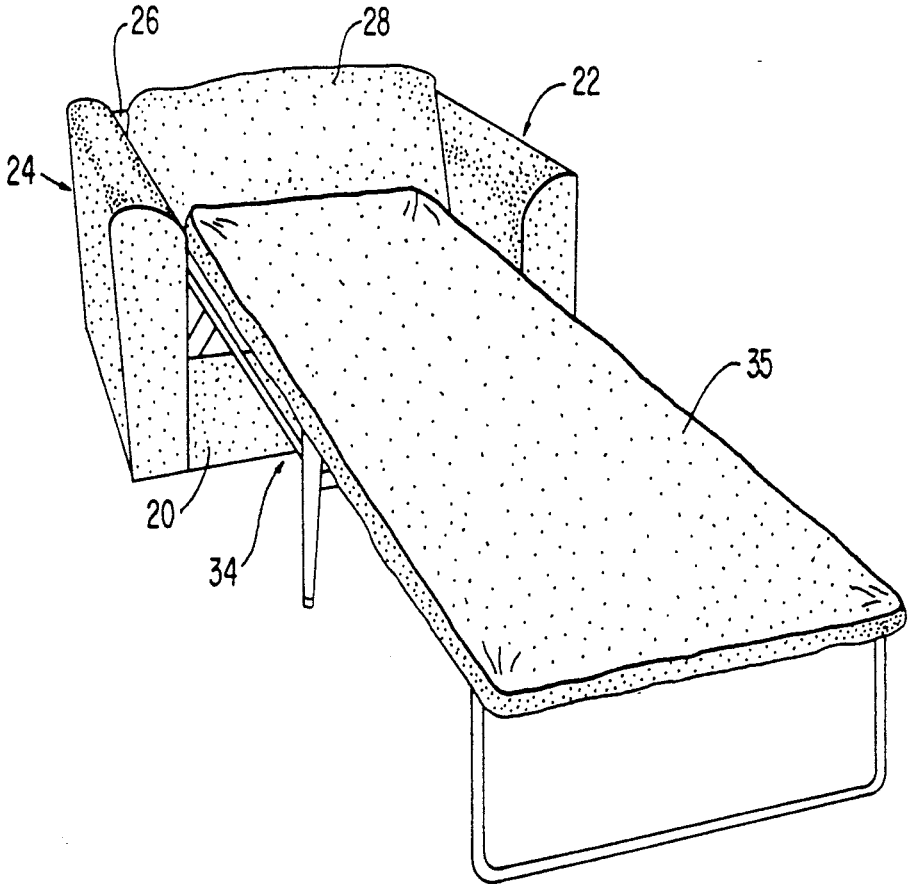
FIG. 10 is a front view of the chair with the sleeper mechanism unfolded.

FIG. 1 illustrates one embodiment of the assembled chair of this invention, as viewed from the front of the chair. The terms "vertical" and "horizontal" as used herein refer to the directions substantially perpendicular and parallel respectively to a floor on which the chair is placed. The chair comprises a vertical front member 20, a first or right-hand vertical arm member 22 and a second or left-hand vertical arm member 24 spaced apart from the right-hand member 22. A back member 26 is interposed between the arm members 22 and 24, and a back cushion 28 and seat cushion 30 are provided. The back cushion 28 may alternatively be replaced by multiple smaller loose pillows or a removably attached back cushion depending upon the style of the piece. As explained hereinafter, the seat cushion 30 is supported by a seat support member which may be either a seat member or spring platform 32 (FIG. 8) or a sleeper mechanism and mattress 34 (FIGS. 9 and 10). A suitable sleeper mechanism is manufactured by Leggett & Platt.

Figure 2:
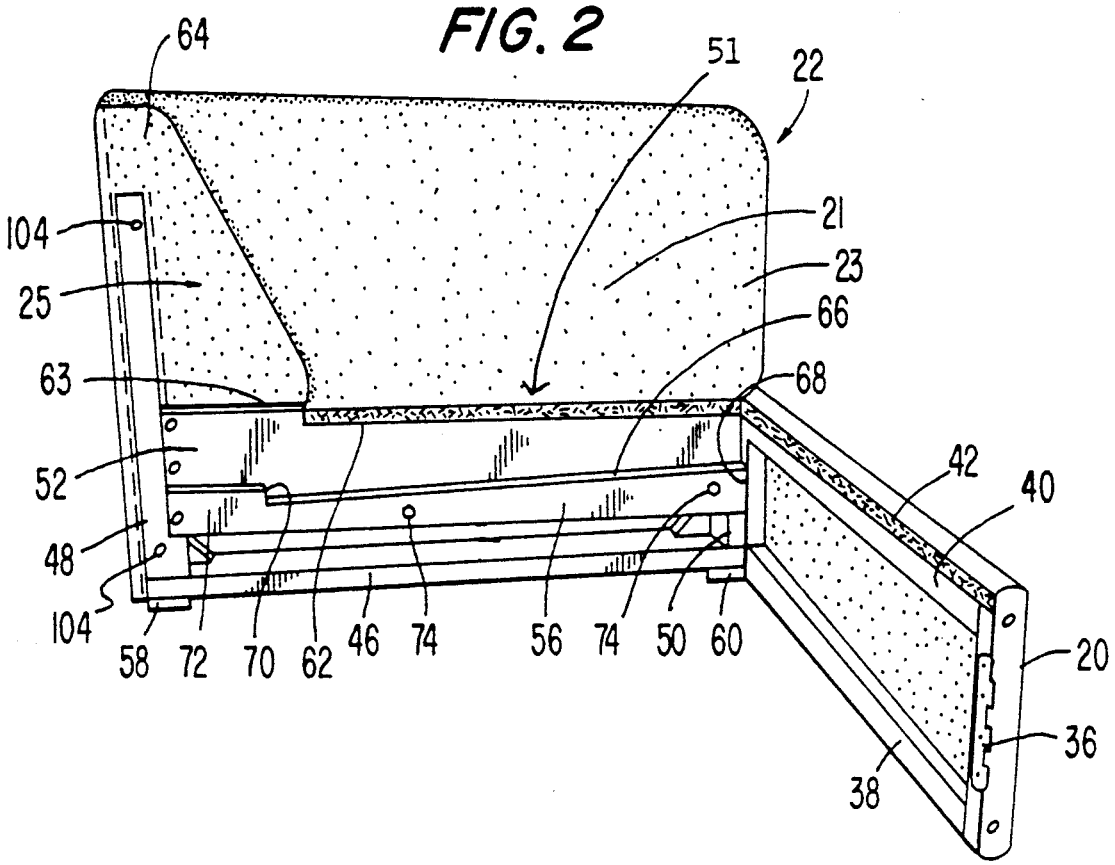
FIG. 2 is a perspective view of the partially disassembled chair showing the inside of the right arm and the front panel thereof.

Referring to FIG. 2, the front member 20 consists of a wooden frame, preferably upholstered, having horizontal bottom and top front rails 38 and 40 respectively. A hook and loop fastening strip 42 extends along the top front rail 40 for a purpose to be explained hereinafter. The hook and loop fastening strip 42, and the other such fastening strips disclosed hereinafter, are of the type identified by the trademark Aplix.

Figure 4:
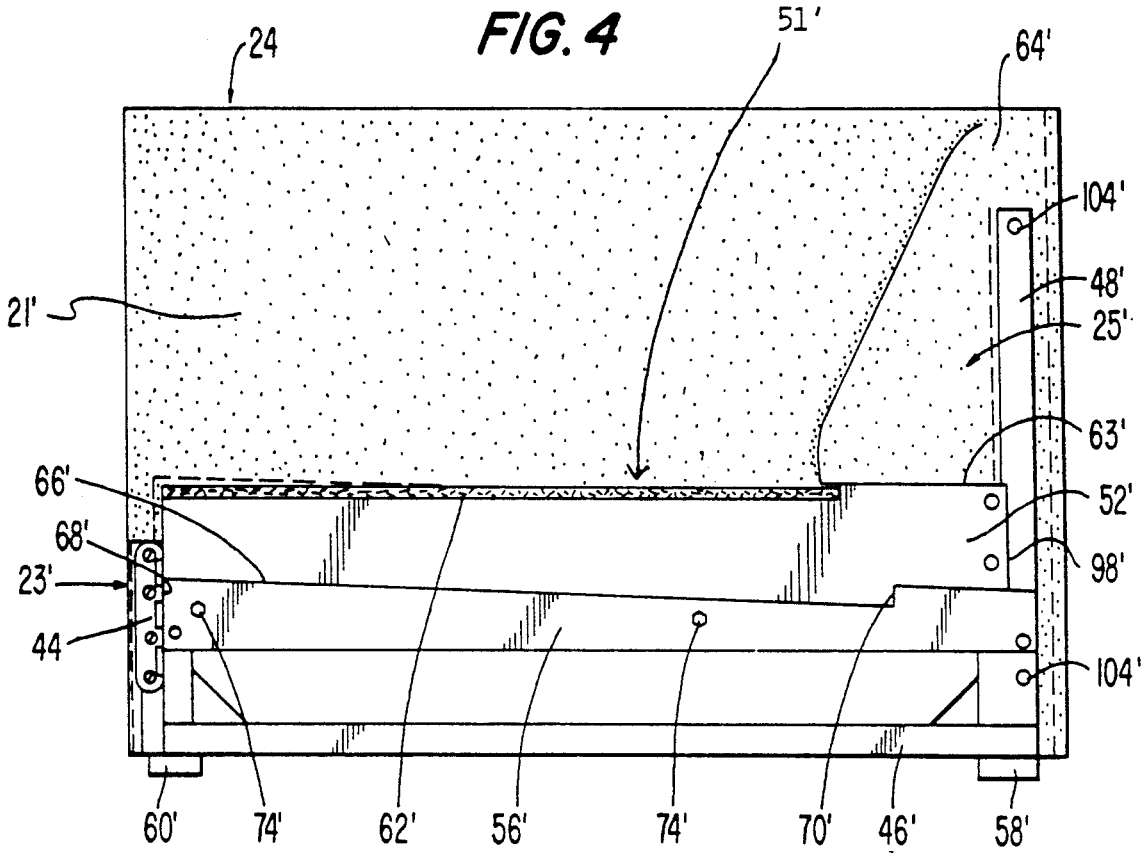
FIG. 4 illustrates the inside portion of the left arm.

One half 36 of a conventional three-pronged stamped metal fastener known as a bed hook is secured to an end of the front member 20 and the other half 44 is routed into the front portion 23 of the left arm member 24, as illustrated in FIG. 4. Identical bed hook halves are attached to the other end of the front member 20 and to the front portion 23' of the right arm member 22. The bed hooks permit the front member 20 to be easily attached and detached from the arm members 22 and 24. If desired, a latching or locking device (not shown) may be attached to each end of the front member 20 and to the arm members 22, 24 below the bed hooks, although such a device is not usually required.

As shown in FIG. 2, the arm member 22 comprises a horizontal bottom arm rail 46, back and front substantially vertical arm members 48 and 50 respectively attached to and inner surface 21 of member 22, and a side support section 51 comprising a horizontal side base plate 52 attached to the inner surface 21 of arm member 22 and a side support member 56 attached to the side base plate 52. Legs 58 and 60 are attached to the bottom of horizontal bottom arm rail 46. A horizontal hook and loop fastening strip 62 extends along the top of horizontal side base plate 52 from the front of the plate to a shelf 63 at the top of plate 52. For some arm styles in which the inside of arm 22 is substantially parallel to the side base plate 52, shelf 63 defines the lower end of a shaped indented portion 64 of the inner surface of arm member 22. For other arm styles which curve outward from the side base plate 52 (see FIG. 13), no indentation is required to expose shelf 63.

The top surface 66 of the side support member 56 slopes downward with respect to a horizontal plane parallel to the floor from the front end 68 of member 56 to a step 70 adjacent the back end 72 of this member. Hanger bolts 74 are provided in the side support member 56 for supporting the sleeper mechanism, as will be explained hereinafter.

The left-hand vertical arm member 24 shown in FIG. 4, which has been given the same reference numerals as the right-hand vertical arm member 22 except that they are followed by a prime (′), is a mirror image of arm member 22 and therefore will not be separately described.

Figure 3:
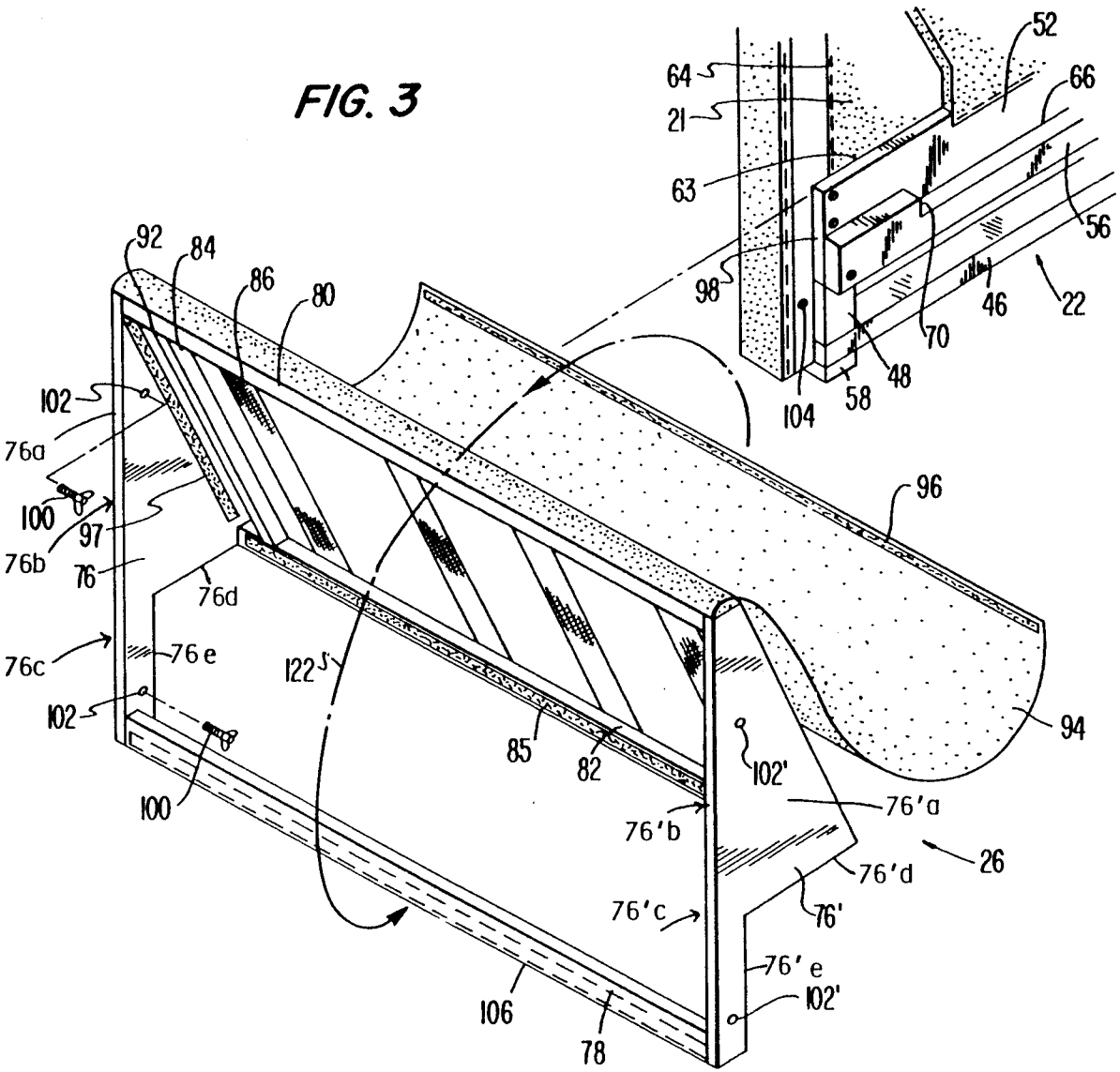
FIG. 3 is an exploded perspective view of the right arm and back member of the chair showing how they are assembled.
Figure 5:
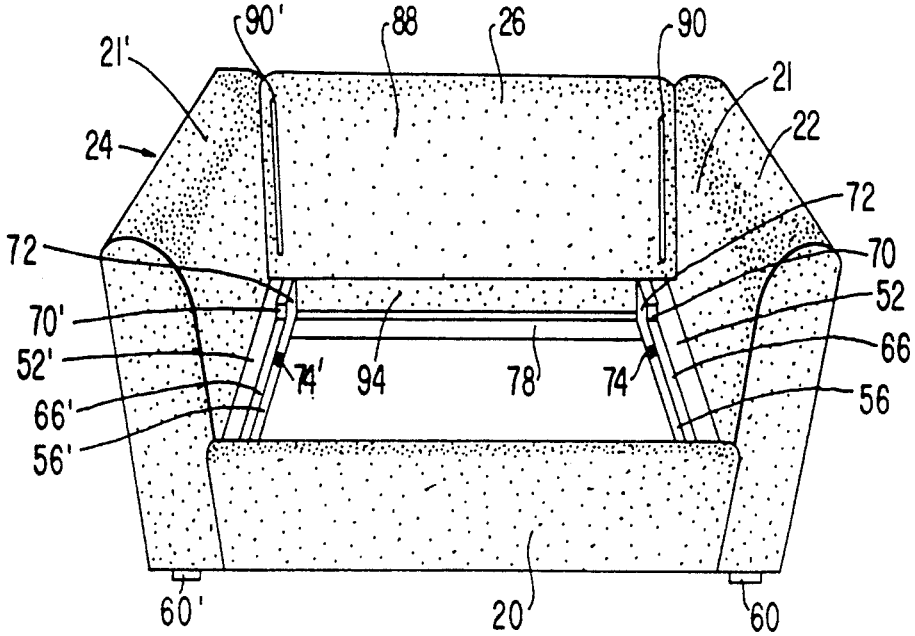
FIG. 5 is a front view of the chair with the seat cushion, back cushion and spring platform removed.
Figure 6:
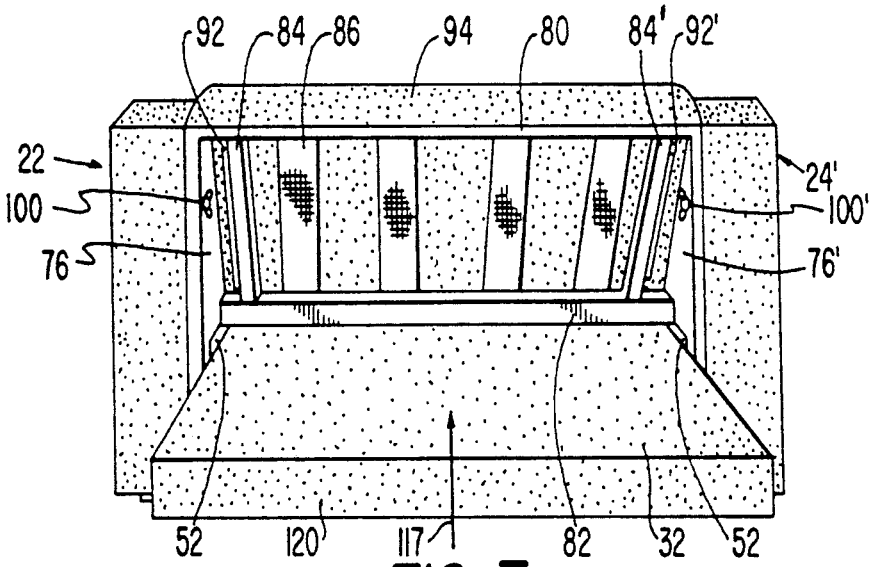
FIG. 6 is a rear view of the chair with a fabric flap folded up over the front of the back member and the spring platform partially installed.
Figure 7:
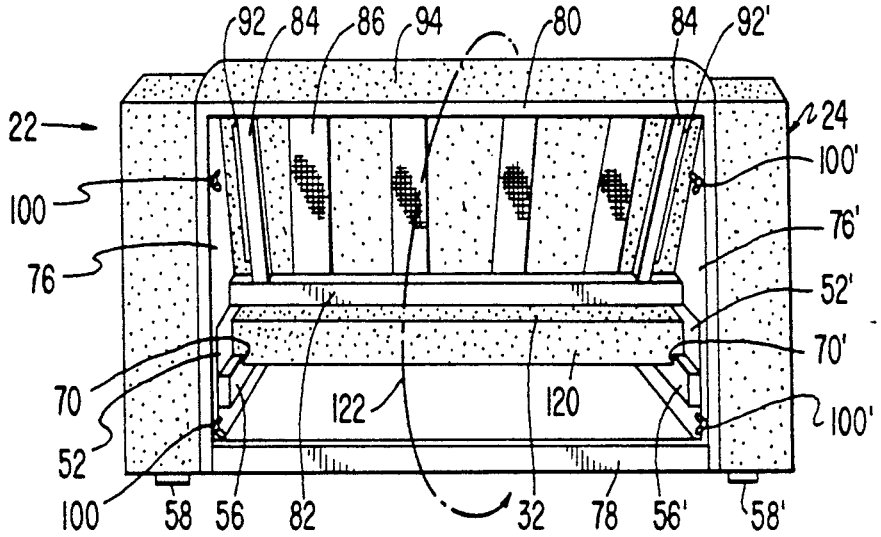
FIG. 7 is a rear view of the chair with the fabric flap folded up over the front of the back member and the spring platform installed in the chair.

As best shown in FIGS. 3, 6 and 7, the back member 26 comprises right and left-hand back insert sections 76 and 76′ respectively, a back horizontal bottom rail 78, a back horizontal top rail 80, a back horizontal intermediate rail 82, and right and left-hand back support members 84 and 84′. The insert sections 76, 76′ each having a side surface 76*a*, 76′*a*, an upper portion 76*b*, 76′*b* and a lower portion 76*c*, 76′*c*, the lower portions 76*c*, 76′*c* each having a substantially horizontal part 76*d*, 76′*d* and a substantially vertical part 76*e*, 76′*e*. A horizontal hook and loop fastening strip 85 is attached to the back intermediate rail 82. Webbing 86 is attached to the back horizontal top rail 80 and the horizontal intermediate rail 82, although springs may be used instead of webbing. As shown in FIGS. 5 and 9, the front surfaces of the webbing 86 (or springs) are covered with upholstery 88 having slits 90 and 90′ cut in the sides of the upholstery. Slit 90 is in registration with a space 92 between the right back insert section 76 and right back vertical support member 84, and slit 90′ is in registration with a space 92′ between the left back insert section 76′ and the left back vertical support member 84′. A fabric flap 94 having one end attached to the back horizontal top rail 80 and having a horizontal hook and loop fastening strip 96 attached to the other end of the flap is provided to cover the back of the chair, as described below. A hook and loop fastening strip 97 is secured to the inside of the insert section 76, and a similar strip (not shown) is attached to the insert section 76′.

The back member 26 is removably attached to back portions 25, 25′ of the right and left vertical arm members 22 and 24 by sliding the right and left back insert sections 76 and 76′ onto the top rear shelves 63, 63′ of the horizontal side base plates 52, 52′ until they abut the back ends 98, 98′ of the horizontal side base plate members 52, 52′ and can go no further. Thumb screws 100, 100′, or other suitable fastening devices, are inserted through apertures 102, 102′ in sections 76,76′ of the back member 26 and into holes 104, 104′ of arm members 22, 24 respectively. Holes 104, 104′ are provided with suitable receptacles (not shown) for receiving screws 100, 100′ thereby ensuring that the back member is securely attached to the arm members 22, 24, and that the chair can be easily disassembled.

Figure 12:
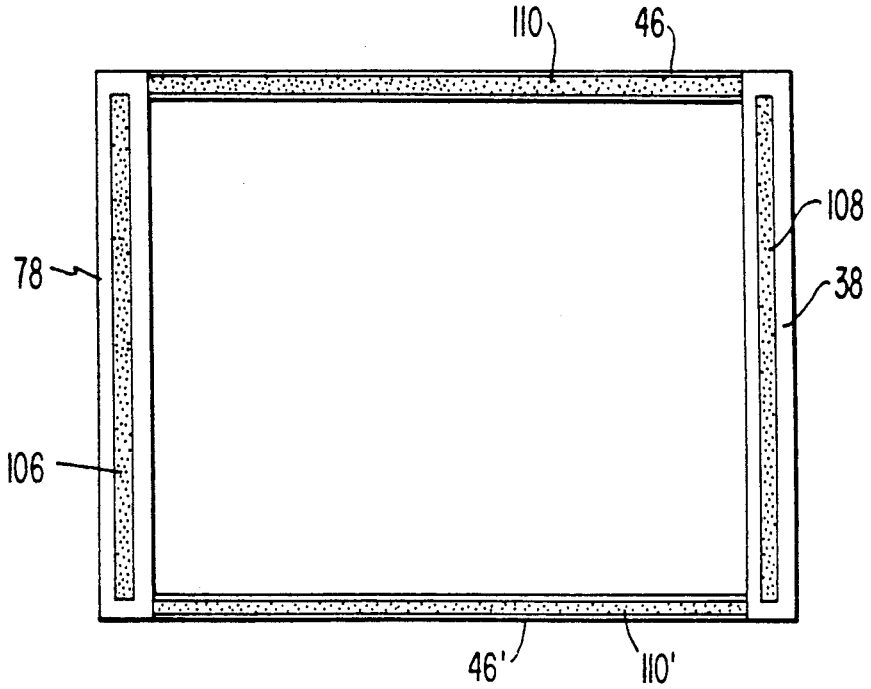
FIG. 12 is a bottom view of the chair showing attachment points for a removable cover.

FIG. 12 is a view of the bottom of the chair. As shown, hook and loop fastening strips 106, 108, 110 and 110′ are attached to the bottoms of the back horizontal bottom rail 78, the front horizontal bottom rail 38, the horizontal bottom arm rail 46 and the horizontal bottom arm rail 46′ respectively.

Figure 8:
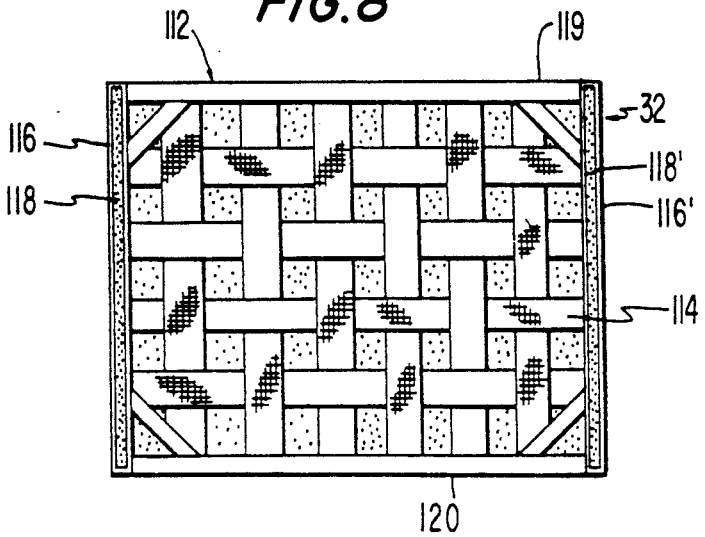
FIG. 8 shows the spring platform viewed from the bottom.

The spring platform 32 shown in FIG. 8 comprises a rectangular frame 112 having webbing 114 attached thereto which is covered with foam and fabric. Alternatively, springs may be used in place of the webbing. Strips 118, 118′ of felt-like material are attached to bottom portions 116, 116′ of the frame 112.

After the back member 26 has been attached to the arm members 22 and 24, either the spring platform 32 or the sleeper mechanism and mattress 34 may be installed in the chair. If the spring platform 32 is desired, the platform is inserted into the chair in the direction of arrow 117, as shown in FIG. 6. Then, as shown in FIG. 7, the platform is slid over the back horizontal bottom rail 78 onto the top surfaces 66, 66′ of the angled side support members 56,56′ so that the front end 119 of the spring platform 32 fits against the front member 20 and the back end 120 of the spring platform 32 fits into and rests against the steps 70, 70′ in the side support members to provide a comfortable sitting position. The strips of felt-like material 118, 118′ attached to parts 116, 116′ of the frame 112 permit the spring platform 32 to slide smoothly when inserted and increase the stability of the platform.

Alternatively, if the sleeper mechanism and mattress 34 is desired, it is inserted from below the chair and attached by hook-type appendages (not shown) on the sleeper mechanism to hanger bolts 74 and 74′ shown in FIGS. 2, 4 and 5.

Next, the fabric flap 94 attached to the back horizontal top rail 80 is swung toward the rear of the chair so as to cover the back of the back member 26, as indicated by arrows 122 in FIGS. 3 and 7. The hook and loop fastening strip 96 is then removably attached to the mating hook and loop fastening strip 106 attached to the bottom of the back horizontal bottom rail 78. The seat cushion 30 rests upon either the spring platform 32 or the sleeper mechanism 34 depending upon which unit has been installed. The back cushion 28 rests upon the seat cushion 30 and also against the back member 26.

Figure 11:
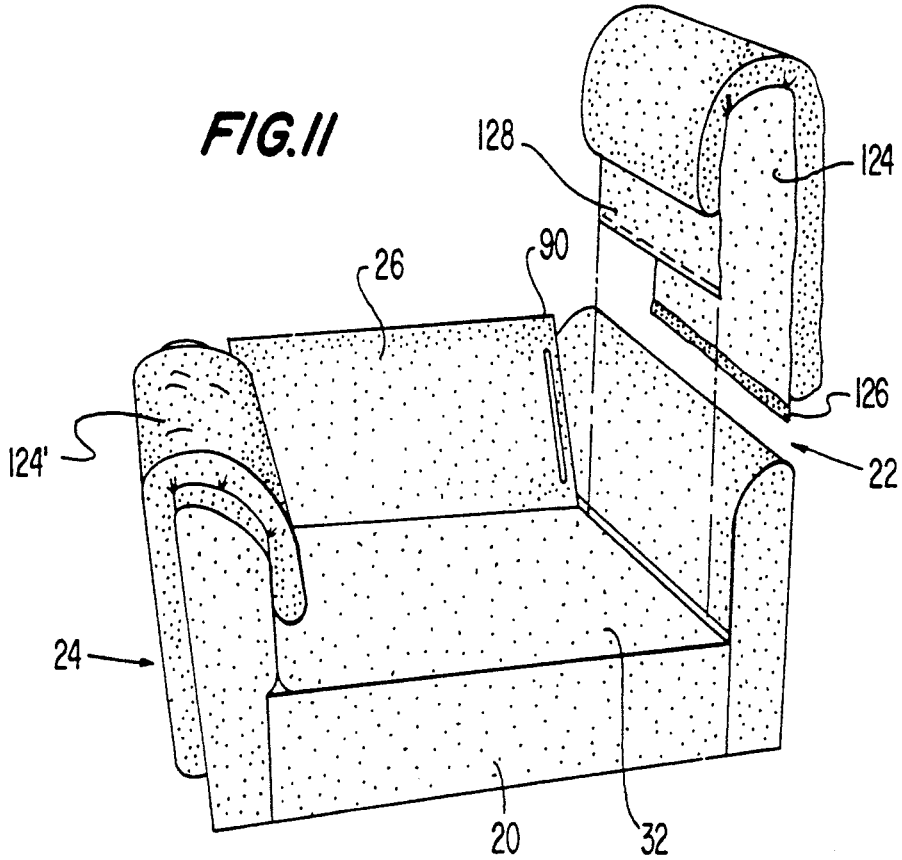
FIG. 11 is a front view of the chair with the back and seat cushions removed, and showing detachable covers.

A removable cover may be placed over the chair and fastened by means of hook and loop fastening strips on the cover and the hook and loop fastening strips on the chair. Referring to FIG. 11, a removable cover 124 is attached to the right arm 22 by removably attaching hook and loop end fastening strip 126 to mating hook and loop fastening strip 110 attached to the bottom of horizontal bottom arm rail 46. A tab 128 is provided which is removably attached by a hook and loop fastening strip (not shown) to mating hook and loop fastening strip 62 on horizontal side base plate 52. Similarly, removable cover 124′ is attached to the left arm 24 by attaching hook and loop fastening strips (not shown) to mating strips 110' on the bottom of horizontal bottom arm rail 46' and 62' on horizontal side base plate 52'.

In the same way, a removable cover which is placed over the entire chair can be provided which, by means of a second set of hook and loop fastening strips on the cover, is attached a second set of mating hook and loop fastening strips 108, 110 and 110' on the bottom of the chair, strip 42 on the front member 20, strips 62, 62' on the base plates 52, 52', strip 85 on the back intermediate rail 82 and, for some styles, strips 97, 97' on back insert sections 76, 76'. Vertical slits 90 and 90' on back member 26 provided access to strips 97 and 97'.

Figure 14:
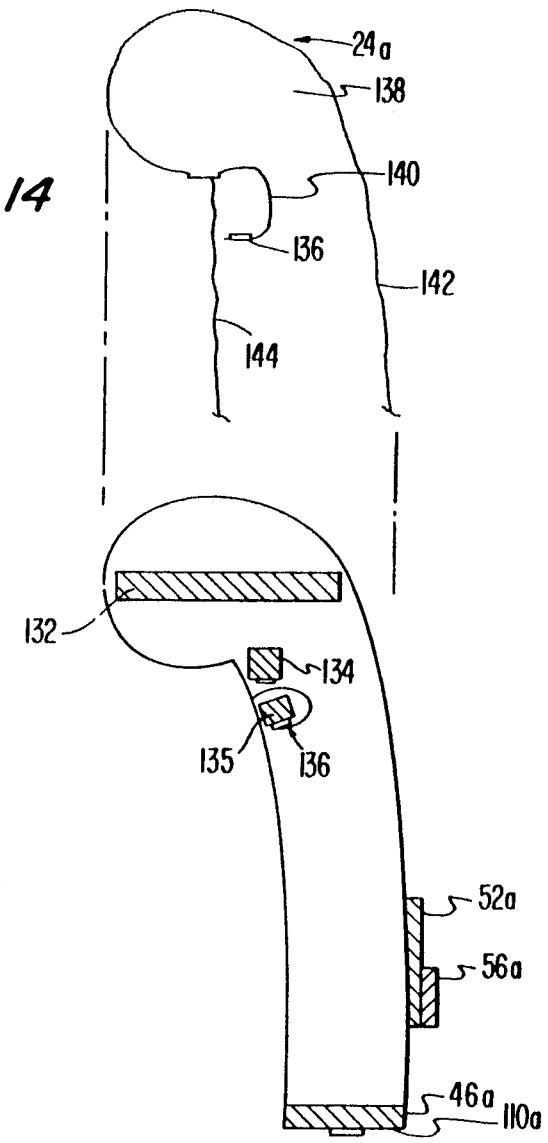
FIG. 14 is a front cross-section view taken along the lines 14—14 of FIG. 13 and a portion of the removable cover, showing fastening locations for attaching the cover to the arm.
Figure 13:
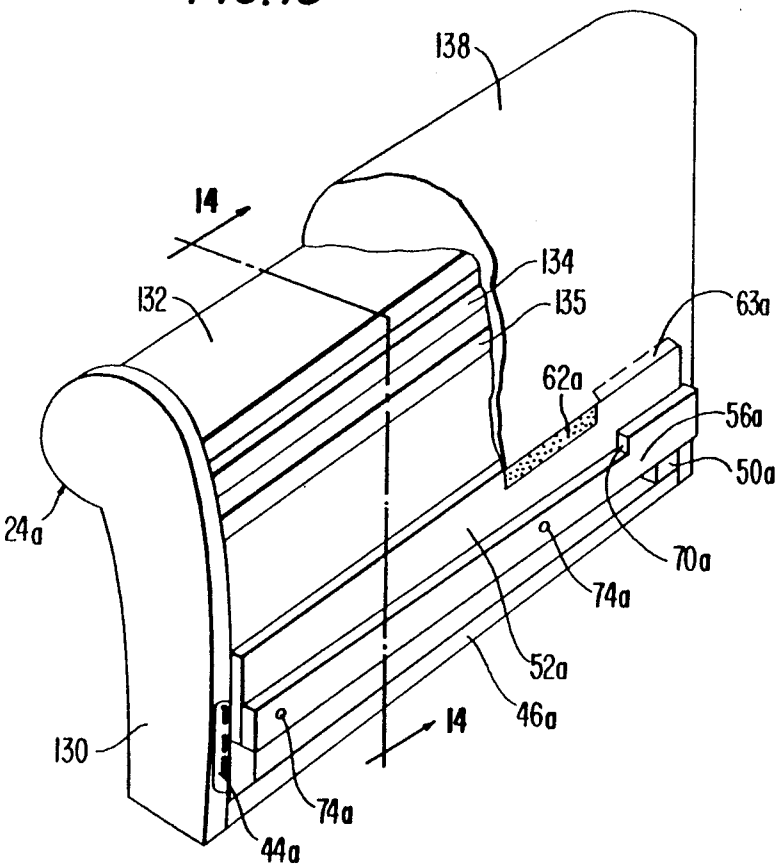
FIG. 13 is a perspective cut-away view of the inside of the left arm with a portion of the upholstery broken away to show details of the arm construction and of the arrangement for securing a removable cover over an arm having a curved shape.

FIG. 13 is a perspective cut-away view of the left arm **24*a* of an embodiment of the invention wherein the arm is curved, and FIG. 14 is a cross section of the arm shown in FIG. 13 taken along the plane 14—14 showing means for attaching a cover that will retain the curved appearance of the arm. Elements corresponding to those shown in FIG. 4 have been given the same numbers followed by the letter a. In this embodiment, the arm 24*a* comprises front and back end pieces 130 and 50*a*, a horizontal support element 132, a horizontal rail element 134, and a lower horizontal rail element 136 extending between the end pieces 130 and 50*a*. A hook and loop fastenable cover 138 having flaps 140, 142 and 144 is attached to the arm 24*a* by securing the flap 140 to the fastening strip 136, flap 142 to the fastening strip 62*a*, and flap 144 to the fastening strip 110*a* below horizontal bottom rail 46*a***.

While the present invention has been described in detail with respect to preferred embodiments, it will be understood that numerous modifications, changes, variations and equivalents may be made by those skilled in the art without departing from the spirit and scope of the invention. Accordingly, it is intended that the invention herein be limited only by the scope of the appended claims.

We claim:

1. An easily assembled and disassembled upholstered furniture system for mounting on a substantially horizontal surface, comprising first and second spaced apart substantially vertical arm members, each of said first and second arm members having an inner surface including back and front portions;

first and second side support sections affixed to the inner surfaces of said first and second arm members respectively, each of said first and second side support sections including a side support member for removably and interchangeably supporting one of a seat member and a sleeper mechanism said seat member resting on said side support member without means attaching said seat thereto; and a side base plate, said side base plate having a shelf portion and a back end adjacent the back portion of a corresponding arm member;

a back member interposed between said first and second spaced apart arm members, said back member being supported on the shelf portions of said side base plates and abutted against the back ends thereof;

fastening means for removably fastening said back member to said first and second arm members; and a front member interposed between said first and second spaced apart arm members, said front member being removably attached to the inner surfaces of said first and second arm members.

2. An upholstered furniture system as defined by claim 1 wherein each of said side support members includes means for restricting movement of said seat member; and attachment means for supporting said sleeper mechanism.

3. An upholstered furniture system as defined by claim 2 wherein each of said side support members has a top surface for supporting the sides of said seat member, the top surfaces of said first and second side support members sloping downward at a predetermined angle with respect to said horizontal surface in a direction from the front portions of said first and second arm members toward the back portions thereof; and wherein said means for restricting movement of said seat member comprising steps in the top surfaces of said first and second side support members, the back end of said seat member resting against said steps.

4. An upholstered furniture system as defined by claim 1 wherein said back member comprises first and second back insert sections having upper and lower portions, said first and second back insert sections being removably attached by said fastening means to the inner surfaces of said first and second arm members;

a back horizontal bottom rail interposed between the lower portions of said back insert sections;

a back horizontal top rail interposed between the upper portions of said back insert sections; and a back horizontal intermediate rail interposed between said back insert sections intermediate said bottom said top rails, said first and second back insert sections slidably fitting between said first and second arm members, over the shelf portions of said side base plates and abutting against the back ends of said side base plates.

5. An upholstered furniture system as defined by claim 4 wherein said front member is removably attached to the front portions of the inner surfaces of said first and second arm members.

6. An upholstered furniture system as defined by claim 4 wherein said first and second arm members, said back member and said front member are upholstered, and which further comprises a removable cover placed over said first and second arm, back and front members, said removable cover being secured to said members.

7. An upholstered furniture system as defined by claim 6 wherein said front member includes top and bottom front rails, and said first and second members each include bottom rails; wherein said furniture system further comprises a first set of hook and loop fastening strips attached to said top and bottom front rails, the side base plates and bottom rails of said first and second arm members, and the horizontal intermediate rail of said back member; and wherein said removable cover is provided with a second set of hook and loop fastening strips which attach respectively to said first set of hook and loop fastening strips.

8. An upholstered furniture system as defined by claim 7 wherein hook and loop fastening strips are attached to the back insert sections of said back member, and wherein a portion of said removable cover placed over said back member has slits therein for providing access to the hook and loop fastening strips on said back insert sections.

9. An upholstered furniture system as defined by claim 7 wherein a hook and loop fastening strip is attached to the back horizontal bottom rail of said back member, and which further comprises a flap having one end attached to the back horizontal top rail of said back member, said flap having a hook and loop fastening strip attached to an opposite end thereof for attaching to the hook and loop fastening strip on said back horizontal bottom rail.

10. An upholstered furniture system as defined by claim 4 wherein the back portions of said first and second arm members have shaped indented portions therein for receiving said first and second back insert sections.

11. An upholstered furniture system as defined by claim 1 wherein each of said first and second arm members is curved and further comprises a bottom rail having a hook and loop fastening strip attached thereto;

front and back end pieces;

horizontal support and rail elements extending between said end pieces, said rail element having a hook and loop fastening strip attached thereto;

a hook and loop fastening strip attached to said side support section; and a removable cover including first, second and third flaps each having a hook and loop fastening elements thereon for attaching said cover to the fastening strips attached to said rail element, said side support section and said bottom rails respectively.

12. An upholstered furniture system for mounting on a substantially horizontal surface, said furniture system being easily assembled and disassembled, comprising first and second spaced apart substantially vertical arm members, each of said first and second arm members having an inner surface including back and front portions;

first and second side support sections affixed to the inner surfaces of said first and second arm members respectively, each of said first and second side support sections including a side base plate having a shelf portion and a back end adjacent the back portion of said first and second arm members;

a back member interposed between said first and second spaced apart arm members, said back member including first and second back insert sections each having a side surface, an upper portion and a lower portion, each of said lower portions having substantially horizontal and vertical parts;

a back horizontal bottom rail interposed between the vertical parts of the lower portions of said back insert sections;

a back horizontal top rail interposed between the upper portions of said back insert sections; and a back horizontal intermediate rail interposed between said back insert sections intermediate said bottom and top rails, the side surfaces of said first and second back insert sections slidably fitting between said first and second arm members, the substantially horizontal parts of the lower portions of said insert sections being positioned on the shelf portions of said side base plates and the vertical parts of the lower portions of said insert sections abutting against the back ends of said side base plates;

means for removably attaching the first and second back insert sections to said first and second arm members respectively; and a front member interposed between said first and second spaced apart arm members, said front member being attached to the inner surface of said first and second arm members.

13. An upholstered furniture system as defined by claim 12 wherein said front member is removably attached to the front portions of the inner surfaces of said first and second arm members.

14. An upholstered furniture system for mounting on a substantially horizontal surface, comprising first and second upholstered spaced apart substantially vertical arm members, each of said first and second arm members having an inner surface including back and front portions, each of said arm members further including a side base plate and a bottom rail each having a hook and loop fastening strip attached thereto;

first and second side support sections affixed to the inner surfaces of said first and second arm members respectively, each of said first and second side support sections including a side base plate having a shelf portion and a back end adjacent the back portion of said first and second arm members;

an upholstered back member interposed between said first and second spaced apart arm members, said back member including first and second back insert sections each having a side surface, an upper portion and a lower portion, each of said lower portions having substantially horizontal and vertical parts;

a back horizontal bottom rail interposed between the vertical parts of the lower portions of said back insert sections;

a back horizontal top rail interposed between the upper portions of said back insert sections; and a back horizontal intermediate rail interposed between said back insert sections intermediate said bottom and top rails, the side surfaces of said first and second back insert sections slidably fitting between said first and second arm members, the substantially horizontal parts of the lower portions of said insert sections being positioned on the shelf portions of said side base plates and the vertical parts of the lower portions of said insert sections abutting against the back ends of said side base plates, said back horizontal intermediate rail having a hook and loop fastening strip attached thereto;

means for removably attaching the first and second back insert sections to said first and second arm members respectively;

an upholstered front member interposed between said first and second spaced apart arm members, said front member including top and bottom front rails each having a hook and loop fastening strip attached thereto, said front member being attached to the inner surfaces of said first and second arm members, said front member being in removable contact with the front portions of the inner surfaces of said first and second arm members; and a removable cover placed over said upholstered first and second arm, back and front members, said removable cover having a set of hook and loop fastening strips for mating with the hook and loop fastening strips on said arm, back and front members.

15. An upholstered furniture system as defined by claim 14 wherein said front member is removably attached to the front portions of the inner surfaces of said first and second arm members.

16. An easily assembled and disassembled furniture system for mounting on a substantially horizontal surface, comprising first and second spaced apart substantially vertical arm members, each of said first and second arm members having an inner surface including back and front portions;

front and back members interposed between the front and back portions respectively of the inner surfaces of said first and second arm members;

first and second side support members affixed to the inner surfaces of said first and second arm members respectively;

a seat member resting on said side support members without means attaching said seat member thereto;

first fastening means for removably connecting said first and second arm members to said back member, said first fastening means serving solely for securing said first and second arm members to said back member without supporting said seat member; and second fastening means for removably connecting said first and second arm members to said front member, said second fastening means serving solely for securing said first and second arm members to said front member without supporting said seat member.

17. A furniture system as defined by claim 16 which further comprises first and second side base plates affixed to the inner surfaces of said first and second arm members respectively, said side base plates supporting and positioning said back member.

18. A furniture system as defined by claim 16 wherein said first and second arm members are curved, each of said arm members including a bottom rail having a hook and loop fastening strip attached thereto;

front and back end pieces;

horizontal support and rail elements extending between said end pieces, said rail element having a hook and loop fastening strip attached thereto;

a hook and loop fastening strip attached to said side support section; and a removable cover including first, second and third flaps each having hook and loop fastening elements thereon for attaching said cover to the fastening strips attached to said rail element, said side support section and said bottom rails respectively.

19. A furniture system as defined by claim 18 which further comprises first and second side base plates affixed to the inner surfaces of said first and second arm members respectively, said side base plates supporting and positioning said back member.

* * * * *